US006223996B1

(12) United States Patent
Yamamoto

(10) Patent No.: US 6,223,996 B1
(45) Date of Patent: May 1, 2001

(54) ULTRASONIC LIQUID INJECTION DEVICE

(75) Inventor: Yoshiharu Yamamoto, Kyoto (JP)

(73) Assignee: Excel Engineering Co., Ltd., Kyoto (JP)

( * ) Notice: Subject to any disclaimer, the term of this patent is extended or adjusted under 35 U.S.C. 154(b) by 0 days.

(21) Appl. No.: 09/401,321

(22) Filed: Sep. 23, 1999

(51) Int. Cl.[7] ..... B05B 1/02
(52) U.S. Cl. ..... 239/102.2; 239/4
(58) Field of Search ..... 239/102.2, 4

(56) References Cited

U.S. PATENT DOCUMENTS 4,326,553 * 4/1982 Hall ..... 239/102.2 X
5,927,306 * 7/1999 Izumi et al. ..... 239/102.2 X

FOREIGN PATENT DOCUMENTS

49636 * 4/1982 (EP) ..... 239/102.2
77636 * 4/1983 (EP) ..... 239/102.2
10223589 8/1984 (JP) .
2521730 5/1996 (JP) .
10-305248 11/1998 (JP) .
157241 * 3/1964 (SU) ..... 239/102.2

* cited by examiner

*Primary Examiner*—Lesley D. Morris
(74) *Attorney, Agent, or Firm*—Finnegan, Henderson, Farabow, Garrett & Dunner, L.L.P.

(57) ABSTRACT

A device capable of continually injecting a liquid through propagation of ultrasonic waves. The device comprises: a nozzle 1 having an injection orifice 11 and a connection orifice 10 for connecting with the liquid supply pipe 3; and a vibrator 2 installed on the block section of the nozzle, facing the injection orifice 11; said nozzle 1 having a discharge outlet 12 for the discharge of excess liquid in the side facing the connection orifice 10.

7 Claims, 2 Drawing Sheets

ULTRASONIC LIQUID INJECTION DEVICE

TECHNICAL FIELD

This invention relates to a liquid injection device which, in detail, propagates ultrasonic waves in a liquid and, through that energy, injects the liquid.

BACKGROUND ART

The technology to introduce ultrasonic energy in a liquid to accelerate the liquid flow is applied to humidifiers and washers. This takes place through putting the liquid in contact with ultrasonic vibrators and propagating ultrasonic waves in the liquid.

For example, a liquid injection washer is used for cleaning of electronic components, precision machinery, etc. As shown in FIG. 2, the washer is equipped with nozzle 1 which is fixed to face gravitationally downwards, vibrator 2 which is installed on the block section which faces injection orifice 11 of the nozzle 1, and supply pipe 3 which is connected to side of the nozzle 1 to supply liquid detergent. The vibrator 2 excites the liquid detergent, which is supplied through the supply pipe 3 into the nozzle 1, so as to give the liquid an extra acceleration in addition to the acceleration provided by gravity, thus resulting in the liquid injecting itself onto a physical object. Accordingly, for washers, in order to have the ultrasonic waves operate effectively in the liquid and manifest its cleaning capacity fully, liquid contact plane 2*a* of the vibrator 2 must continually be in contact with the liquid at the time of excitation. If the vibrator is excited when the liquid contact plane 2*a* is not in contact with the liquid, not only the cleaning capacity will be inadequate but also the vibrator will vibrate excessively and reduce its life-span. If the excessive vibration continues, the vibrator will break down.

However, in actuality, air which remains in the nozzle 1 or the supply pipe 3 or an air bubble which is formed within liquid, even if the liquid is supplied adequately, is not perfectly expelled from the injection orifice 11 and remains on the liquid contact plane. Normally, because the nozzle 1 is used with the injection orifice 11 facing downwards and because the vibrator 2 is in a higher position than the injection orifice 11 and supply pipe connection orifice 10, if an air bubble remains within the nozzle 1, the air bubble cannot escape and is in continuous contact with the liquid contact plane.

For conventional liquid injection washers, to prevent the improper operation of the vibrator 2, it was necessary to stop the excitation of the vibrator 2 and turn the injection orifice 11 upwards to expel the air bubble. In this case, because expelling the air bubble after it had built up into a large quantity would be too late to prevent excessive vibration, it is necessary to expel the air bubble little by little when only small volume has formed.

However, it is difficult to detect a small quantity of air bubble and, if the excitation of the vibrator is regularly and frequently stopped to expel the air bubble, its injection efficiency is poor. Furthermore, depending on the cleaning method, there are occasions when the mixing of chemicals such as hydrofluoric acid and ammonia is required but, because an air bubble forms easily at the time of mixing the chemicals, it was not possible with conventional liquid injection washers to use with chemicals.

SUMMARY OF THE INVENTION

For that reason, an object of this invention is to provide a liquid injection device that has an excellent durability.

Another object of this invention is to provide a liquid injection device where it is difficult for an air bubble to develop. Still another object of this invention is a liquid injection device where, even in the unlikely event that an air bubble develops, it is possible to expel the bubble without stopping the operation of the device.

The liquid injection device according to this invention comprises a nozzle and a vibrator. The nozzle has an injection orifice, a connection orifice opened on the side of the nozzle in order to connect with the supply pipe which supplies the liquid, and a discharge outlet for the discharge of excess liquid in the side facing the connection orifice. The vibrator is installed on the block section which faces the injection orifice, for the propagation of the ultrasonic waves in the supplied liquid.

The above objects and novel features of the invention will more fully appear from the following detailed description and the preferred embodiment when the same are read in connection with the accompanying drawing. It is to be expressly understood, however, that the drawing is for purpose of illustration only and is not intended as a definition of the limits of the invention.

DETAILED DESCRIPTION OF THE INVENTION

Through the provision of the above-mentioned special feature, of liquid supplied by the supply pipe, the bulk of the liquid necessary for the injection is injected from the injection orifice and the remaining portion is discharged from the discharge outlet. An air bubble in the nozzle is pushed out the discharge outlet by the drained liquid.

It is desirable that the aforementioned vibrator is installed in such a way that its virtual plane, including the liquid contact plane, intersect with the discharge outlet. If that is the case, because, if the device is used with the injection orifice facing downwards, the position of the discharge outlet becomes the same height as or higher than the liquid contact plane, the air bubble buoyancy will move the air bubble in the direction of the discharge outlet to make air bubble expulsion easier. It is desirable that the internal diameter of the discharge outlet is smaller than the internal diameter of the connection orifice, and it is particularly desirable that it be between ⅕ and ⅗ of the internal diameter of the connection orifice. That is because, if that is the case, the injection pressure of the liquid will be maintained at a high level.

Because, with this invention of a liquid injection device, it is difficult for an air bubble to develop and, even if the bubble does, it is possible to swiftly expel the air bubble without stopping the excitation of the vibrator, it is possible for the vibrator to have a long life-span. Furthermore, its benefits include the facts that, when used as a washer, washing efficiency is excellent, and that the use of chemicals is possible.

DESCRIPTION OF THE PREFERRED EMBODIMENTS

Figure 1:
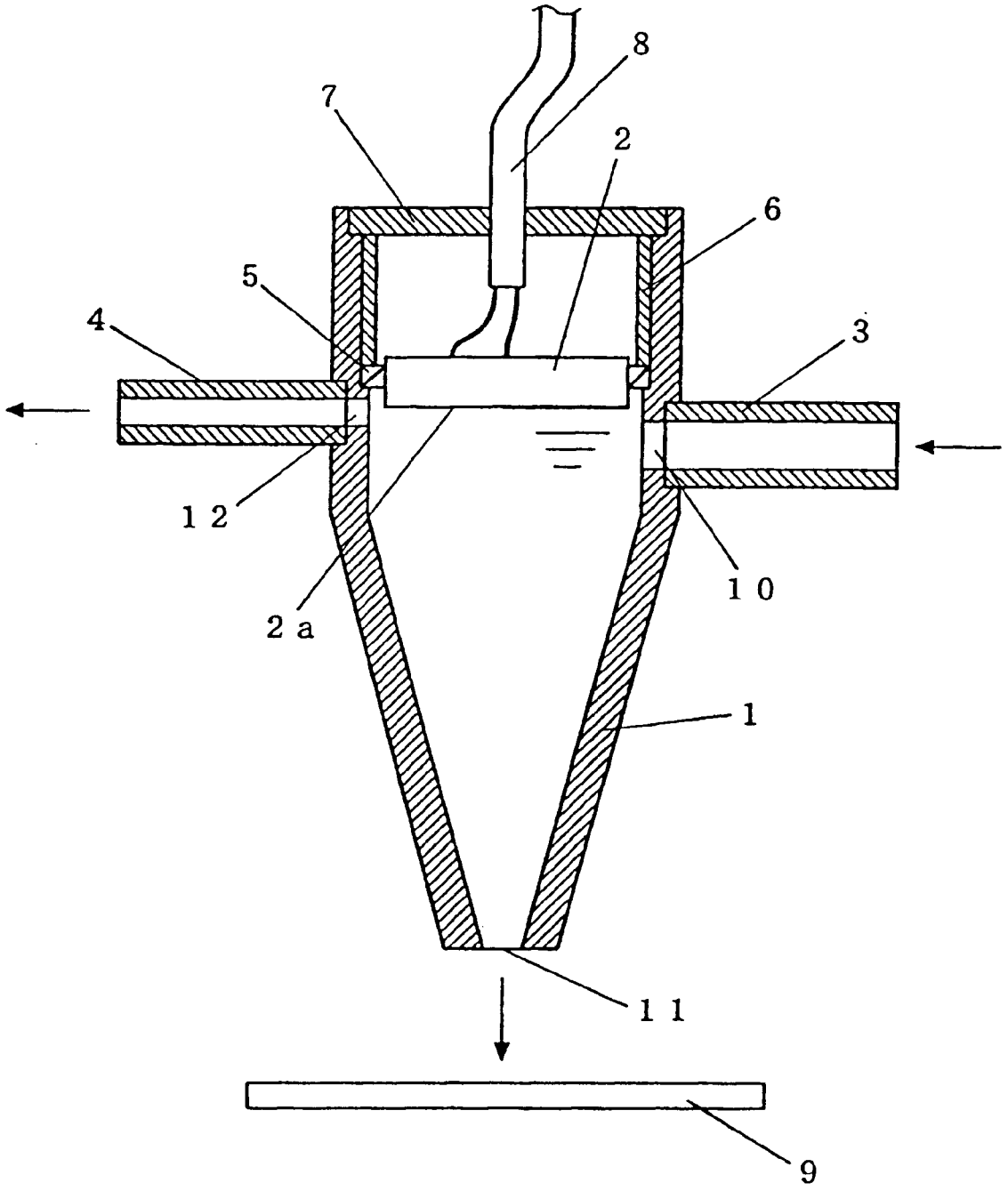
FIG. 1 is a cross-sectional view of a liquid injection device embodying the present invention.
Figure 2:
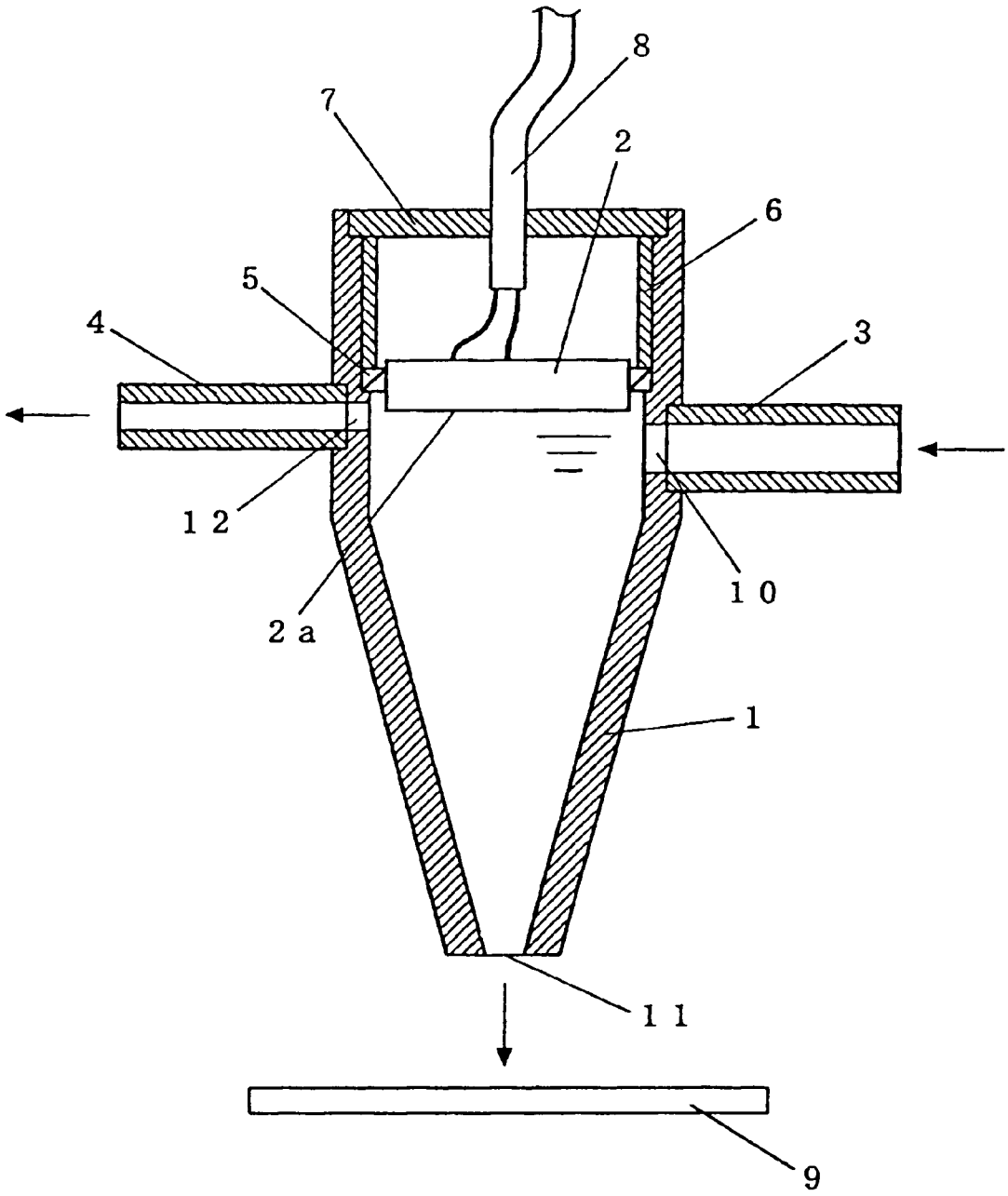
Fig 2 PRIOR ART
FIG. 2 is a cross-sectional view of a conventional liquid injection device.

Referring to the drawings, there is shown a preferred Actual Embodiment of a liquid injection device of the present invention.

This liquid injection device is an ultrasonic washer which consists of nozzle 1, vibrator 2 which is installed on the block section which faces injection orifice 11 of the nozzle 1, and supply pipe 3 which is connected to side of the nozzle 1 to supply liquid into the nozzle. As shown in the drawing, injection orifice 11 of this device should face downwards, with the object 9 to be cleaned being fixed below the injection orifice and the vibrator 2 propagates ultrasonic waves to the liquid supplied through the supply pipe 3, thus resulting in the liquid injecting itself through injection orifice 11 onto the object to be cleaned.

On the side facing supply pipe connection orifice 10 of the nozzle 1, discharge outlet 12 which discharges excess liquid is provided. The internal diameters of the connection orifice 10 and discharge outlet 12 are 6 mm and 4 mm respectively. Discharge pipe 4 is connected to the discharge outlet 12. The vibrator 2 is kept by collar 6 at an appropriate distance and fixed to rear end 7 of the nozzle 1. In addition to them, packing 5 interposed between the vibrator 2 and the collar 6 prevents the liquid from leaking out the rear of the vibrator 2. This is because, if the liquid leaked behind the vibrator 2, lead 8 would short-circuit within the space encompassed by the collar 6. Furthermore, the positional relationship of the vibrator 2 and the discharge outlet 12 is fixed so that virtual plane including liquid contact plane 2*a* intersect with the discharge outlet 12. Accordingly, when, as shown in the drawing, the injection orifice 11 faces downwards, the upper tip of the discharge outlet 12 is slightly above the liquid contact plane 2*a* of the vibrator.

In relation to this device, while liquid is being injected from the injection orifice 11, a portion of the liquid will be regularly discharged from the discharge outlet 12. Accordingly, an air bubble within nozzle 1 will, immediately after forming, be pushed out the discharge outlet 12 by the liquid being discharged. Moreover, because the position of the upper tip of the discharge outlet 12 is higher than the liquid contact plane 2*a*, the air bubble's own buoyancy cooperates and it easily escapes from the discharge outlet 12.

As a result, an air bubble does not build up in the nozzle 1.

What is claimed is:

1. A device for injecting a liquid through propagation of ultrasonic waves, said device comprising:

a nozzle having an injection orifice, a rear end section opposite the injection orifice, and a connection orifice opened on a side of the nozzle to connect with a supply pipe for the liquid; and a vibrator installed on the rear end section and facing the injection orifice, for the propagation of the ultrasonic waves in the liquid supplied through the connection orifice, the vibrator having a virtual plane including a liquid contact plane;

said nozzle having a discharge outlet for the discharge of excess liquid from a side of the nozzle facing the connection orifice, the vibrator being installed so that the virtual plane including the liquid contact plane intersect with the discharge outlet.

2. The device of claim 1, wherein the discharge outlet has an internal diameter smaller than that of the connection orifice.

3. The device of claim 2, wherein the internal diameter of the discharge outlet is between ⅕ and ⅗ of that of the connection orifice.

4. The device of claim 1, further comprising a collar installed between the rear end of the nozzle and the vibrator, the collar maintaining the vibrator at an installed position.

5. The device of claim 1, wherein the liquid is a liquid detergent.

6. A device for injecting a liquid through propagation of ultrasonic waves, said device comprising:

a nozzle having an injection orifice, a rear end section opposite the injection orifice, and a connection orifice opened on a side of the nozzle to connect with a supply pipe for the liquid; and a vibrator installed on the rear end section and facing the injection orifice, for the propagation of the ultrasonic waves in the liquid supplied through the connection orifice, the vibrator having a liquid contact plane;

said nozzle having a discharge outlet for the discharge of air bubbles in the side facing the connection orifice and wherein the vibrator is installed so that the liquid contact plane of the vibrator does not move higher than the discharge outlet.

7. The device of claim 6, further comprising a collar installed between the rear end of the nozzle and the vibrator, the collar maintaining the vibrator at an installed position.

* * * * *